US005595350A

United States Patent [19]

Massaro, Jr. et al.

[11] Patent Number: 5,595,350

[45] Date of Patent: Jan. 21, 1997

[54] COMMINUTION DEVICE

[75] Inventors: Michael R. Massaro, Jr.; Robert H. Holland, both of Whitehall; William J. Spess, Allentown, all of Pa.

[73] Assignee: Fuller Company, Bethlehem, Pa.

[21] Appl. No.: 80,174

[22] Filed: Jun. 21, 1993

[51] Int. Cl.[6] ..... B02C 4/02; B02C 4/08

[52] U.S. Cl. ..... 241/65; 241/231; 241/235

[58] Field of Search ..... 241/65, 142, 143, 241/145, 236, 231, 159, 280, 235

[56] References Cited

U.S. PATENT DOCUMENTS 2,794,603 6/1957 Peters ..... 241/159 X 4,600,106 7/1986 Minardi ..... 209/862

*Primary Examiner*—John M. Husar

*Attorney, Agent, or Firm*—Daniel De Joseph

[57] ABSTRACT

The present invention relates to a comminution device suitable for use in a cooling apparatus for cooling crushable material. The device is located at a source for such crushable material and typically comprises at least two rolls in series, which are crushing rolls wherein material is crushed in a material crushing area located between said two crushing rolls. It is a advantageous feature of the device of the present invention in that the position of at least one of the crushing rolls is adjustable relative to the other crushing roll to thereby change the dimension of the material crushing area.

28 Claims, 4 Drawing Sheets

COMMINUTION DEVICE

BACKGROUND OF THE INVENTION

The invention relates to a comminution apparatus that is suitable to be operated in conjunction with a material cooler for cooling cement clinker and other materials.

The present comminution apparatus is utilized in a cooling apparatus of the general class for cooling particulate material (e.g., cement clinker or other mineral materials), which has been burnt in a kiln or heated by some other process. Such apparatus can comprise traveling grate coolers, thrust grate coolers, G Coolers and the like. The method of operation of the above and other coolers is well known in the art. For example, in reciprocating grate coolers, the hot particulate material discharged from the kiln outlet typically undergoes quenching in the material inlet part of the cooling apparatus and is then moved, distributed as well as possible, to consecutive rows of grates on which additional cooling is then carried out while the material to be cooled is transported along a path extending from the material inlet to the material outlet of the cooler on said grates. Typically, the cooling air which is blown through the hot material in the recuperation zone of the cooling apparatus is then reused or recycled further generally as air for combustion in the preceding kiln.

In reciprocating grate coolers, grates for cooling or combustion are generally equipped with overlapping rows of grate plates, of which some are mounted in a fixed position and others are reciprocating, which generally means that they oscillate in a longitudinal direction, with the forward stroke of the reciprocation being the direction in which the particulate material to be cooled travels through the cooler, and they thereby serve in part to facilitate the movement of the material through the cooler. The grate plates are mounted on a carrier beam which is transverse to the direction of material flow through the cooler, with adjoining grate plates abutting. The air needed for cooling or combustion is introduced from below the grate plates through port like openings to enter, penetrate and pass through the bed of material to be cooled or burned, with said material lying on top of the grate plate.

Typical clinker coolers are comprised of one or more (typically up to as many as four) drive sections. Each drive section will move, in a reciprocating manner, as an assembly of grate plates. Typically, such an assembly of grate plates will be comprised of from about 15 to about 45 rows of grate plates, with each row being comprised of 6 to 18 individual grates.

Roll breakers have been used in conjunction with such clinker cooler installations for more than a decade. The main purpose of this equipment is to maintain a majority of the clinker particles, which of course are unevenly sized, that pass through at least a portion of a cooling apparatus below a specified diameter, which typically is 25 mm or less, because there is better heat transfer between cooling air and small clinker particles. Typically, a roll breaker will contain at least two rolls in series, and generally between two to six rolls, with each roller assembly being supported by a frame and with all the rolls being of the same size and on a fixed center line. The rolls are contained within a common frame.

In one example of prior art, Great Britain patent application 2,016,952A teaches a roll breaker that has at least two crushing rolls located at the end of a cooling grate underneath a screen assembly with there being a further roll crusher with at least two crushing rolls provided downstream of the screen assembly. Another type of roll breaker known in the art contains, in addition to crushing rolls, one or more so-called transport rolls, which transport rolls rotate in the same direction and serve to deliver the larger pieces of material to at least one pair of crushing rolls. The crushing rolls rotate in opposite directions to each other to thereby draw the material into the gap located between the crushing rolls, whereupon the material will be broken down into smaller pieces. This gap between crushing rolls is set at a certain desired dimension to provide clinker particles having an optimum size for heat transfer. However, the crushing rolls are of course subject to extreme wear and, with extended use, the gap between the crushing rolls will increase and the resulting size of the crushed particles will become larger than the desired optimum size, thereby reducing the efficiency of the heat transfer process of the cooler. When such prior art roll breakers become worn, it has been typical for the user to elect to run the crushers with such a wider gap, which obviously impacts on the efficiency of the cooler. Otherwise, the cooler must be shut down for a lengthy period of time in order to replace any worn rolls or worn segments on each roller, at a considerable cost.

In addition, many prior art roll breakers of the type described are not particularly effective in transporting material into the gap between the crushing rolls, thus causing a back up of material and thus reducing the efficiency of both the roll breaker and the cooling apparatus.

It would be advantageous, therefore, to have a roll breaker in which the gap between the rolls can, such as at times when the rolls begin to exhibit wear, be adjusted in a comparatively fast, efficient and inexpensive manner. In addition, it would be advantageous to provide for a roll breaker which has a more efficient material transport and crushing mechanism.

SUMMARY

The above and other objects of the present invention are realized by the roll breaker device for material such as cement clinker described herein, which is suitable for use in a grate type cooling apparatus. The device will be fed by a material source and may be utilized at the exit of the cooling apparatus or between two consecutive grate assemblies within a cooling apparatus, or, depending on the type of cooling apparatus being utilized, at the entrance to a cooling apparatus, in the latter case to thereby receive material directly from a kiln (which generally precedes clinker coolers). The comminution device of the present invention will have at least two crushing rolls, and will preferably have at least three rolls located in series. Typically, the device will have a pair of crushing rolls that act in combination to crush the material, with the other roll(s) serving to transport the larger particles to the area between the crushing rolls wherein the material is broken up.

In the roll breaker of the present invention, the position of at least one roll is adjustable so that the gap between two consecutive rolls may be increased or decreased depending on the needs of the individual practitioner of the invention. Preferably, if only one roll is adjustable the roll is a crushing roll. Typically, the time needed to adjust the rolls pursuant to the present invention is much less than the time required, as per the prior art, to actually replace worn roll segments on a roller.

In another preferred embodiment of the invention the rolls are not located on a straight horizontal line, but the uppermost point, i.e., the top, of the transport rolls is located at a higher level than the top of the first crushing roll that is immediately adjacent to the transport rolls so that material will naturally move to the first crushing roll by action of gravity, and, furthermore, the top of the last crushing roll, i.e., the roll furthest removed from the transport rolls, is, in the most preferred embodiment of the invention, located higher than the top of the crushing roll adjacent thereto to aid in preventing any material from running off over the last crushing roll and therefore not being crushed. In another preferred embodiment of the invention, the top of the first crushing roll will be at a lower level, and the top of the last crushing roll will be at a higher level, that the other rolls in the roll crushing device. The above-described features promote ease in feeding the roll crushing device and serve to insure that substantially all of the crushable material passes through the gap between the two crushing rolls.

DESCRIPTION OF THE DRAWINGS

All of the Figures are sectional, side views of various embodiments of the invention.

DESCRIPTION OF THE INVENTION

Figure 1:
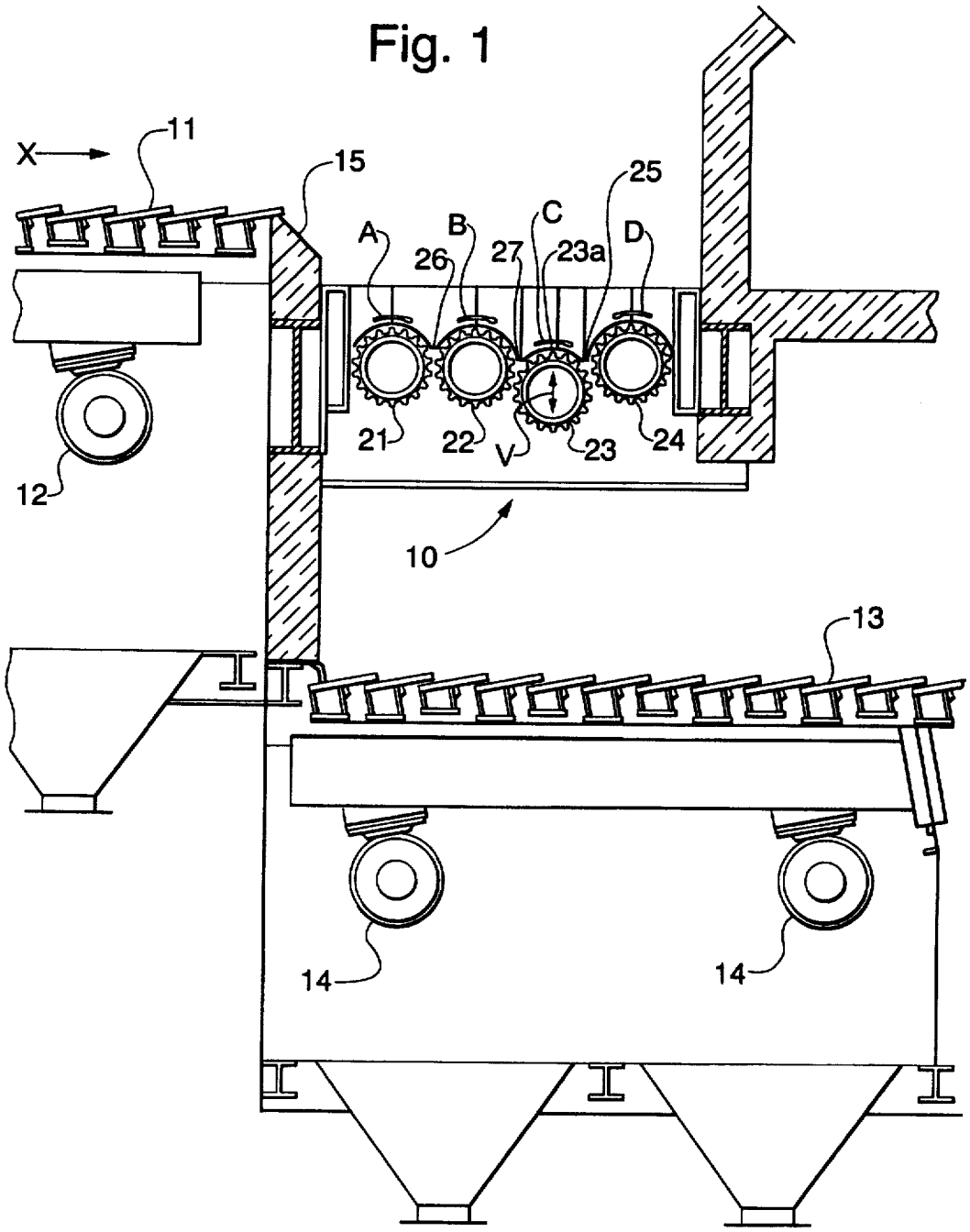
FIGS. 1–3 and 6 depict various preferred embodiments of the roll crusher of the present invention.

Referring to FIG. 1, there is depicted one embodiment of the roll breaker of the present invention generally referred to by the numeral 10.

In the depicted embodiment there is shown a portion of the interior of a cooler wherein device 10 is placed at the end of a first grate assembly 11 consisting of a plurality of rows of reciprocating grate plates, which grate assembly 11 is powered by a drive section generally referred to as 12. It is understood roll breaker 10 can be placed in other locations within a cooler, depending upon the needs of the practitioner of the invention and the specific type of cooler that is utilized. Roll breaker 10 is positioned above a second grate assembly 13, also consisting of a plurality of rows of reciprocating grate plates, which second assembly 13 is powered by drive section 14. Roll breaker 10 consists of, in the depicted embodiment, four rolls in series designated by the numbers 21, 22, 23 and 24. Rolls 21 and 22 serve to screen out the smaller particles (which will pass through the gap 26 between rolls 21 and 22 and gap 27 between rolls 22 and 23) and also as transport rolls, to transport material to crushing rolls 23 and 24. As depicted in FIG. 1, the rotation of the transport rolls 21 and 22 is as specified by, respectively, arrows A and B. Each transport roll 21 and 22 rotates in the same direction as does first crushing roll 23, i.e., in the direction of Arrow C. In the perspective of FIG. 1, Arrows A, B and C all rotate in a clockwise direction.

Clinker material will be transported in the cooler by the reciprocating motion of the grates located in grate assembly 11 in the direction of Arrow X. Clinker material will first fall from outlet 15 onto transport roll 21. Larger material which fails to fall through gaps 26 and 27 at rolls 21 and 22 will be moved by the rotation of transport roll 21 to transport roll 22 and thereafter to crushing roll 23, which, as indicated, rotates in the same direction as rolls 21 and 22. Since crushing roll 24 rotates in an opposite direction, as shown by Arrow D, to that of crushing roll 23, particles will be drawn into the comminution area 25 which is the gap between rolls 23 and 24.

As indicated in addition to moving clinker to crushing area or gap 25, transport rolls 21 and 22 will serve the function of filtering off smaller particles. Such smaller particles will tend to fall between gap 26 that is between rolls 21 and 22 or gap 27 that is between rolls 22 and 23 and fall onto the next consecutive second grate plate assembly 13, or, if crushing device 10 is placed at another location within a cooler, go to the next process step.

In addition, material comminuted by the action of crushing rolls 23 and 24 will pass through the comminution area 25 and will fall onto the second grate assembly 13 of reciprocating grate plates.

As indicated, it is understood that the depicted placement of device 10 between two consecutive grate assemblies is one optional embodiment. In other optional embodiments, and dependent upon the type of cooler device 10 is utilized in, device 10 may, in addition or alternately to the embodiment shown in FIG. 1 be placed at the end of the last grate assembly in a cooler, or before the first grate assembly directly after the material outlet of a kiln.

It is a unique feature of the roll crusher of the present invention in that at least one of the rolls, and preferably at least one of the crushing rolls, is moveable, i.e., the roll is adjustable. The range of motion of the adjustable roll is limited only by the needs of the individual practitioner of the invention. Typically, the roll can be moveable in any direction, so that the dimensions of the space or gap between the adjustable roll and a roll adjacent thereto will be altered. A practitioner of the invention may find it desirable in certain applications to limit the movement of the roll to either being substantially vertical or substantially horizontal, which includes, respectively, exactly vertical or horizontal movements and reasonable variations, i.e., up to about 45° , therefrom.

The apparatus depicted in FIG. 1 contains certain unique features of the present invention. The crushing roll 23 is adjustable substantially vertically in the general direction of double arrow V. Therefore, by moving crushing roll in the appropriate direction the dimensions of the gap 25 between crushing rolls 23 and 24 and the gap 27 between crushing roll 23 and transport roll 22 can be increased or decreased depending on the needs of individual practitioner of the invention. This results in improved service life on the individual segments 35 of crushing rolls 23 and 24 and transport roll 22 due to the adjustability of the crushing roll assembly. Because of this ability to compensate, through adjustment of the position of roller 23, the gap between the shaft assemblies of rolls 22, 23 and 24 can be reduced, thereby maintaining the clinker particle size distribution at the last three shaft assemblies at virtually a constant state.

In addition, it will be appreciated that in the embodiment set forth in FIG. 1 rolls 21–24 are not located on the same horizontal plane, and in particular, the top, i.e., the uppermost point **23*a*, of crushing roll 23 is located at a lower level than the uppermost points of the other rolls in the roll breaker, and furthermore, crushing roll 24, which is the crushing roll furthest from the source (not shown) of material to the apparatus, is elevated in the depicted embodiment above, not only roll 23, but also rolls 21 and 22. In this depicted embodiment, when roll 23 is raised, gap 27 and gap 25 will both be decreased. The relationship of the rolls to each other for any given installation will be at the discretion of the practitioner of the invention. This unique roll assembly results in benefitting the transport of feed to the crushing area by having the transport rolls 21 and 22 assisting in force feeding large clinker deposits, through the use of gravity, into gap 25. In addition, larger particles are mechanically assisted by transport roll 22 in forcing material into gap 25 by a pushing action, or in some unusual cases very large clinker bowel crushing would occur between rolls 22 and 24**.

Figure 2:
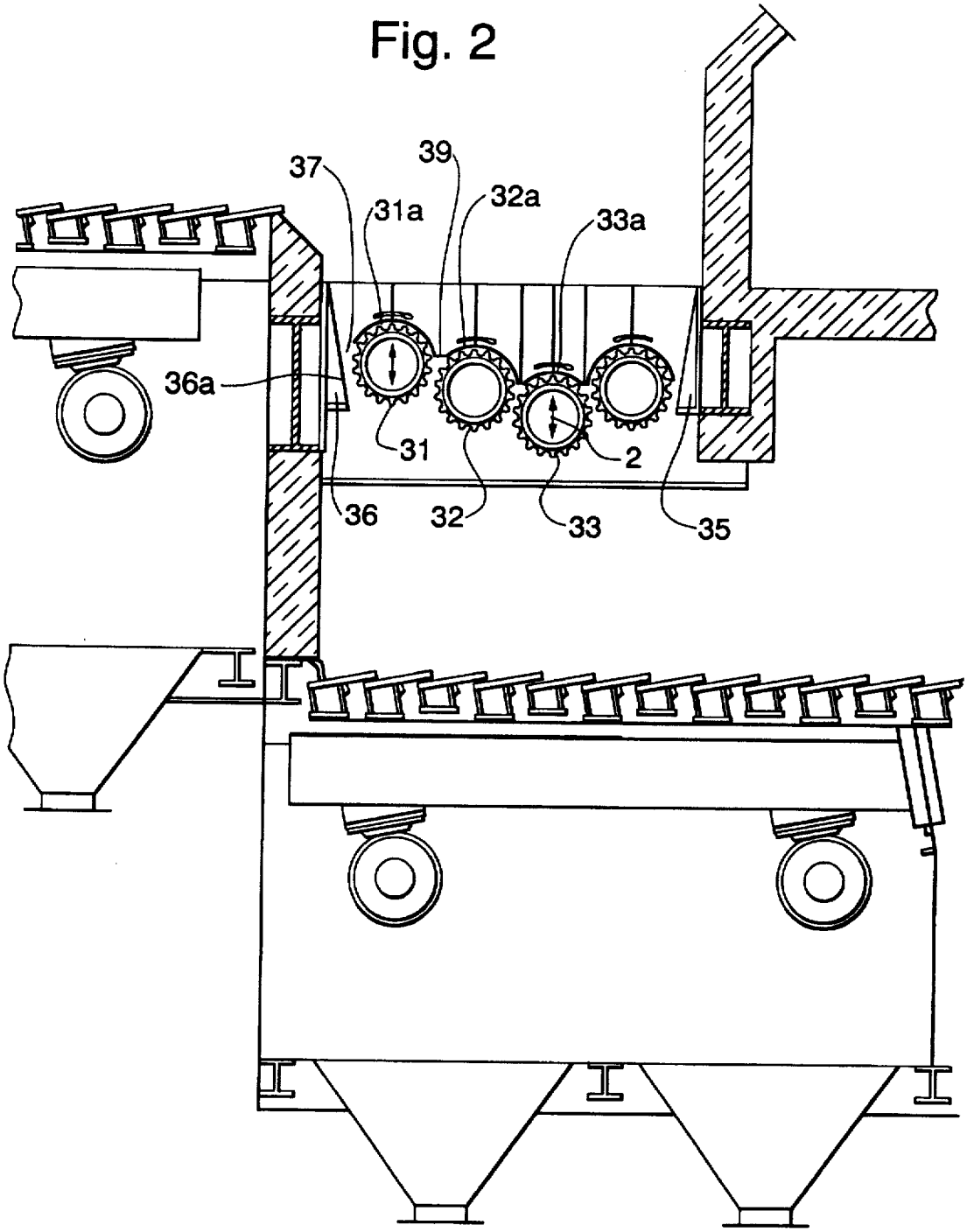

In the embodiment of the roll assembly set forth in FIG. 2, crushing roll 33 is also substantially vertically adjustable in the general direction of double arrows Z. With regard to adjusting a roll's position, it is understood that, as indicated, the term "substantially vertical" does not mean that the roll has to be moved at an angle that is exactly 90 degrees from the horizontal (or, in the case of "substantially horizontal" movement, as discussed below, exactly 90 degrees from the vertical) in order for such adjustment to be effective. In any event, depending upon the needs of the individual practitioner either substantially horizontal or vertical movement of the adjustable roll may be desirable, or, if necessary, the present invention contemplates the possibility of having a roll that is adjustable by being moved in any direction relative to an adjacent roll. As depicted in FIG. 2, transport roll 31 is also vertically adjustable.

FIG. 2 differs from the embodiment of FIG. 1 in that the top 33*a* of first crushing roll 33 is much further vertically displaced from the top 31*a* of the first transport roll 31 as compared to their counterparts in FIG. 1. Furthermore, wherein FIG. 1 depicts the tops 21*a* and 22*a* of transport rolls 21 and 22 as being on the same horizontal level, in FIG. 2 top 32*a* of the second transport roll 32 is at a lower level than the top 31*a* of the first transport roll 31. In addition, the dimensions of gap 39, located between transport rolls 31 and 32, can be changed, since transport roll 31 is vertically adjustable. FIG. 2 depicts another optional feature of the present invention, wherein the dimensions of the gap between a roll and an end liner can be increased or decreased. For example, an end liner that precedes the first roller assembly, or which follows the last roller assembly, can be designed with a sloped exterior surface or an extended surface which protrudes toward the roller assembly. FIG. 2 illustrates side 36*a* of liner 36, which precedes the first roller 31, having a sloped shape. By moving transport roll 31 vertically gap 37 between liner 36 and transport roll 31 will be increased or decreased. Liner 35, which follows the last roller 34, is also similarly sloped.

Figure 5:
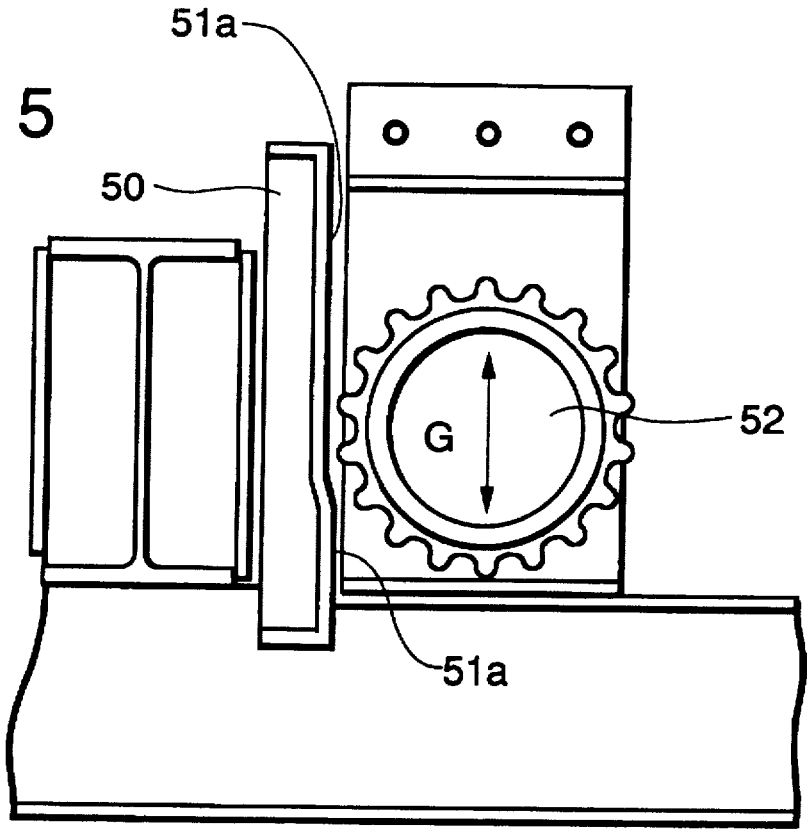

FIG. 5 illustrates another embodiment of this feature, wherein the face 51 of liner 50 has an extended area 51*a* which protrudes toward roller assembly 52. By moving roller 52 vertically in the generally direction of double arrow G, the distance between roller 52 and end liner 50 will be varied. In another embodiment of the invention, the liners themselves can be constructed to be movable mechanically to thereby change the dimensions of the gap between the liner and the roller assembly.

Figure 4:
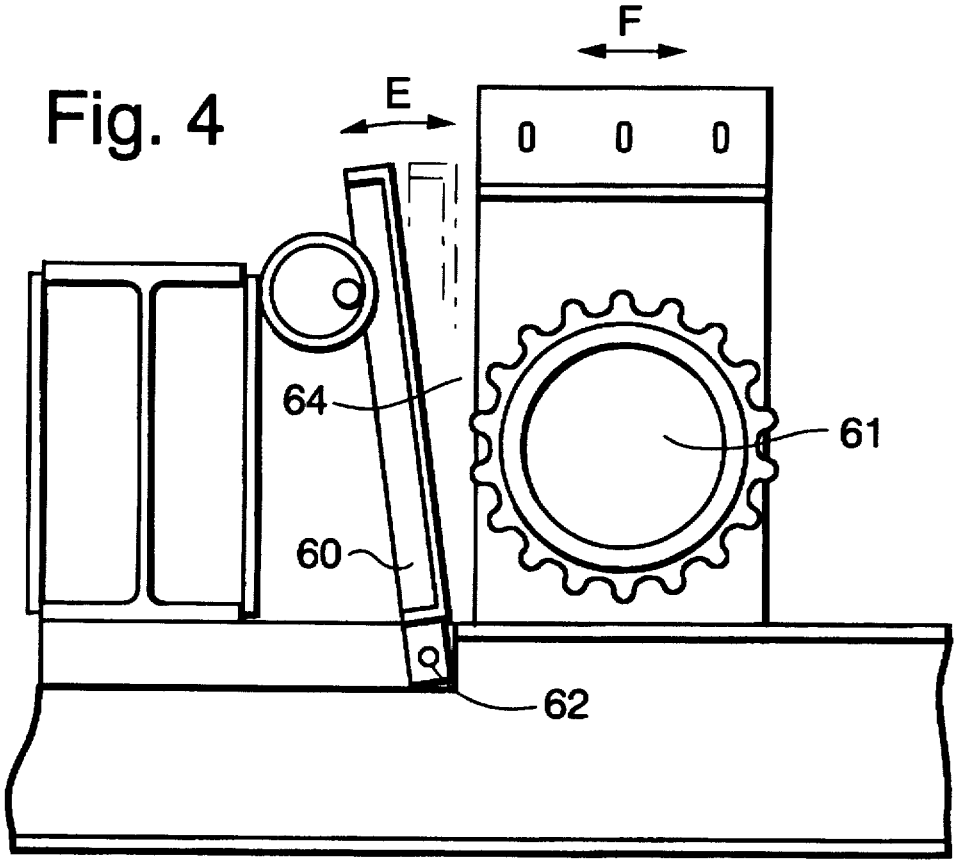
FIGS. 4 and 5 depict alternative embodiments of the present invention, both Figures depicting an end liner and one roll assembly.

FIG. 4 depicts one embodiment of the present invention wherein there is shown a moveable liner. In FIG. 5, liner 60 is moveable toward or away from roller 61. Liner 60 pivots from axis 62 and moves in the directions specified by the double arrow E, so that gap 64 between liner 60 and roll 61 can be increased or decreased depending upon the direction of the movement of liner 60. Obviously, in the depicted embodiment the practitioner of the invention can have further flexibility if roll 61 is also adjustable, such as by being horizontally adjustable in the direction of double arrow F.

Figure 3:
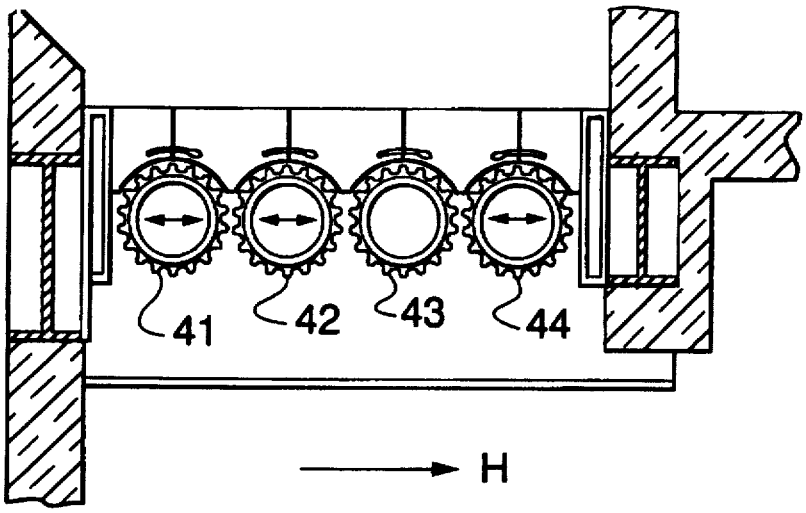

FIG. 3 describes another embodiment of the present invention. In FIG. 3 the rolls are adjusted in a substantially horizontal direction as specified by Arrow H, rather than a vertical direction. In this specific embodiment, first crushing roll 43 is the only fixed, non-adjustable roll. As depicted in FIG. 3, only transport rolls 41 and 42 and crushing roll 44 are adjusted horizontally, and first crushing roll 43 is stationary. In addition the central axis 48 of all of the rolls depicted in FIG. 3 is on a level, identical horizontal plane.

Figure 6:
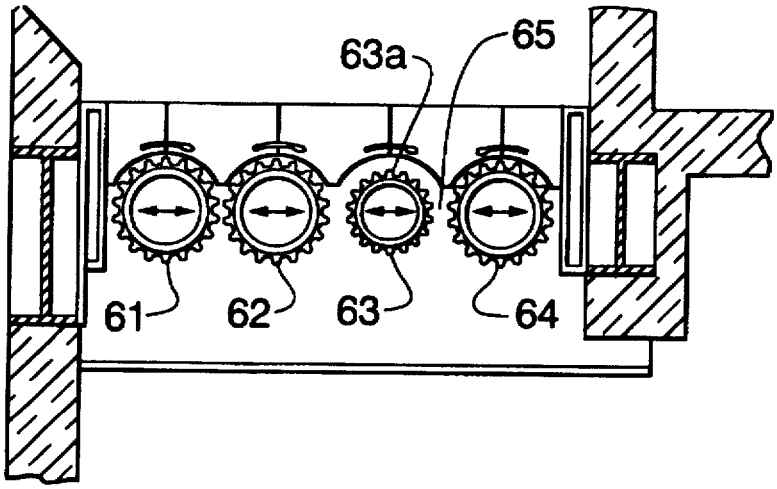

FIG. 6 illustrates another embodiment of the present invention. FIG. 6 is a depiction of a roller assembly having transport rolls 61 and 62 and crushing rolls 63 and 64. In FIG. 6, the center axis of each roll is on the same horizontal plane. However, since first crushing roll 63 is of a smaller diameter than any other roll in the assembly, the top 63*a* of crushing roll 63 is located on a lower level than the tops of the other rolls 61, 62 and 64, which all have identical diameters. This particular embodiment provides for a roller assembly in which material is forced into gap 65 between crushing rolls 63 and 64. Thus, it can be appreciated that the present invention encompasses embodiments wherein (a) all the rolls are of the same size, but the center line of at least one roll is on a different level, i.e., by either being higher or lower, from the other rolls; (b) the horizontal center lines of all the rolls are on the same level, but at least one roll has a different sized diameter from the other rolls; and (c) variables of the above.

Other design schemes can exist which would result in a multitude of combinations which would all be designed to close or otherwise adjust the gaps between adjoining roller assemblies.

In a preferred embodiment of the invention, the frame adjacent to each roller is of a modular construction, in that each roller has its own module which is completely self supporting and self contained, and can be therefore adjusted, with the resulting adjustment of each frame's respective roller, independent of the other module frames in the crusher.

What is claimed is:

1. A device for communicating particulate material having a predetermined minimum size suitable for use in a cooling apparatus for cooling material, said device comprising an assembly of (a) at least two crushing rolls acting in combination to crush said material in a material crushing gap located between said two crushing rolls and (b) at least one transport roll located adjacent to one of said crushing rolls, with there being a gap between each transport roll and the roll located adjacent thereto said transport rolls serving to aid in delivering material of said predetermined size to said material gap, while screening out smaller material through the gap located between each transport roll and the roll located adjacent thereto wherein the position of at least one roll in the assembly is vertically adjustable relative to the roll or rolls adjacent thereto.

2. A device for commuting particulate material having a predetermined minimum size suitable for use in a cooling apparatus for cooling material, said device being fed by a material source and comprising an assembly of at least three rolls in series, wherein the two rolls furthest away from the source are crushing rolls and the remaining roll or rolls are transport rolls which are located adjacent to the crushing roll nearest to the material source, with there being a gap between each transport roll and the roll located adjacent thereto, and serve to transport at least some of said material of said predetermined size to a material crushing gap located between said two crushing rolls while screening out smaller material through the gap located between each transport roll and the roll located adjacent thereto, wherein the position of at least one of said crushing rolls relative to the other crushing roll is adjustable to thereby change the dimension of the material crushing gap.

3. The device of claim 2 wherein the cooling apparatus is a grate type cooler.

4. The device of claim 3 wherein the material source is a material outlet of a cooling grate assembly or kiln.

5. The device of claim 4 wherein the crushing roll nearest the source of material is adjustable.

6. The device of claim 2 in which there are a total of three rolls.

7. The device of claim 2 wherein only one crushing roll is adjustable.

8. The device of claim 7 wherein the adjustable roll is adjustable only in a substantially vertical direction.

9. The device of claim 7 wherein the adjustable roll is adjustable only in a substantially horizontal direction.

10. The device of claim 2 wherein the centerline of all the rolls are on the same horizontal plane.

11. The device of claim 10 wherein at least one of the rolls is of a different sized diameter than the other rolls.

12. The device of claim 11 wherein the differently sized diameter roll is the crushing roll nearest to the material source, wherein further said crushing roll nearest to the material source has a smaller diameter than the other rolls.

13. The device of claim 2 wherein the top of all the rolls are not on the same horizontal plane, and wherein the top of crushing roll located nearest the source of material is at a lower level than any transport roll.

14. The device of claim 2 wherein the rolls are identically sized, and the centerlines of all the rolls are not on the same horizontal plane, and wherein the crushing roll nearest the source of material is at a lower level than any other roll in the device.

15. The device of claim 14 wherein the crushing roll furthest from the source of material is at a higher level than the other roll in the device.

16. The device of claim 2 wherein at least one transport roll is also adjustable.

17. The device of claim 16 wherein said at least one transport roll is adjustable substantially horizontally.

18. The device of claim 16 wherein said at least one transport roll is adjustable substantially vertically.

19. The device of claim 2 wherein a plurality of rolls are adjustable horizontally.

20. The device of claim 2 wherein each roll has a frame adjacent thereto that is of an individual self contained modular construction, capable of movement in the direction of adjustment.

21. The device of claim 2 wherein at least one of said first and last rolls in series in the device are adjacent to the face of a liner means, with there being a space between each liner means and the roll adjacent thereto, wherein at least one of said first and last rolls is adjustable vertically, and wherein further the face of said liner means adjacent to said adjustable roll is of a non-vertical configuration, so that when said roll is adjusted vertically the dimensions of the space between said liner means and the roll will be changed.

22. The device of claim 2 wherein at least one of said first and last rolls in series in the device are adjacent to the face of a liner means, with there being a space between each liner means and the roll adjacent thereto, wherein at least one of said liner means is moveable thereby changing the dimension of the space between said adjustable liner means and the roll adjacent thereto.

23. A grate type cooling apparatus for cooling material that has been heated by a kiln, said apparatus having a material inlet for material exiting said kiln and a material outlet, said apparatus comprising at least one grate assembly for transporting material through said apparatus from said material inlet to said material outlet, said apparatus also comprising a roll crushing device for comminuting material of a predetermined minimum size that enters said device from a material source, said device comprising at least three rolls located adjacent and in series, with the two rolls furthest from the material source being rolls for crushing material, with the remaining rolls being rolls for transporting said material of said predetermined size to said crushing rolls, while screening out smaller material through a gap located between each transport roll and the roll located adjacent thereto, wherein the position of at least one of said rolls relative to the roll or rolls adjacent thereto is vertically adjustable.

24. The cooling apparatus of claim 23, wherein the roll crushing device is located proximate to the material inlet of the apparatus.

25. The cooling apparatus of claim 23, wherein the roll crushing device is located proximate to the material outlet of the apparatus.

26. The cooling apparatus of claim 23 which contains at least two grate assemblies, wherein the roll crushing device is located intermediate two consecutive grate assemblies.

27. A comminution device suitable for use in a cooling apparatus for cooling particulate material, said device comprising an assembly of at least two crushing rolls acting in combination to crush said material of a predetermined size in a material crushing gap located between said two crushing rolls and at least one transport roll located adjacent to one of said crushing rolls which serves to aid in delivering material of said predetermined size to said material gap while screening out smaller material in a gap located between each transport roll and the roll located adjacent thereto, wherein the centerline of all the rolls are on the same horizontal plane, and wherein at least one of the rolls is of a different sized diameter than the other rolls.

28. A comminution device suitable for use in a cooling apparatus for cooling particulate material, said device being fed by a material source and comprising an assembly of at least two crushing rolls acting in combination to crush said material of a predetermined size in a material crushing gap located between said two crushing rolls and at least one transport roll located adjacent to one of said crushing rolls which serves to aid in delivering material of said predetermined size to said material gap while screening cut smaller material in a gap located between each transport roll and the roll located adjacent thereto, wherein the rolls are similarly sized, and the centerlines of all the rolls are not on the same horizontal plane, and wherein the crushing roll nearest the source of material is at a lower level than any other roll in the device.

* * * * *